US006988316B1

(12) United States Patent
Kweon et al.

(10) Patent No.: US 6,988,316 B1
(45) Date of Patent: Jan. 24, 2006

(54) PROCESS FOR MANUFACTURING A FLUID JETTING APPARATUS

(75) Inventors: Soon-cheol Kweon, Seoul (KR); Byoung-chan Lee, Seoul (KR); Kyoung-jin Park, Kyungki-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 09/455,152

(22) Filed: Dec. 6, 1999

(30) Foreign Application Priority Data

Dec. 10, 1998 (KR) ..... 98-54149

(51) Int. Cl.
*B21D 53/76* (2006.01)
*H05B 3/06* (2006.01)

(52) U.S. Cl. ..... 29/890.1; 29/611; 29/DIG. 1; 29/DIG. 16; 29/423; 216/27; 347/26; 347/47; 156/250

(58) Field of Classification Search ..... 29/611, 29/890.1, 25.35, DIG. 1, DIG. 16, DIG. 26, 29/423; 347/26, 47, 63; 216/27, 88, 89; 156/250, 156/252, 253, 292; 451/36, 38
See application file for complete search history.

(56) References Cited

U.S. PATENT DOCUMENTS

| | | | | |
|---|---|---|---|---|
| 4,792,818 A | * | 12/1988 | Eldridge et al. | 347/63 |
| 5,394,180 A | | 2/1995 | Soucemarianadin et al. | 347/77 |
| 5,588,597 A | * | 12/1996 | Reinecke et al. | 347/47 X |
| 5,818,478 A | * | 10/1998 | Gibson | 29/611 X |
| 5,895,313 A | * | 4/1999 | Ikezaki et al. | 451/38 |

FOREIGN PATENT DOCUMENTS

| | | | | |
|---|---|---|---|---|
| JP | 56-113470 | * | 9/1981 | 29/890.1 |
| JP | 60-082357 | | 5/1985 | |
| JP | 05-177838 | | 7/1993 | |

* cited by examiner

*Primary Examiner*—A. Dexter Tugbang
(74) *Attorney, Agent, or Firm*—Stein, McEwen & Bui, LLP

(57) ABSTRACT

A manufacturing method of a fluid jetting apparatus, including: forming a heat driving part, a membrane, and a nozzle part; and forming a nozzle and jetting fluid chambers sequentially by using one nozzle plate, and assembling the heat driving part, the membrane, and the nozzle part, sequentially.

24 Claims, 13 Drawing Sheets

PROCESS FOR MANUFACTURING A FLUID JETTING APPARATUS

CROSS-REFERENCE TO RELATED APPLICATIONS

This application claims the benefit of Korean Application No. 98-54149, filed Dec. 10, 1998, in the Korean Patent Office, the disclosure of which is incorporated herein by reference.

BACKGROUND OF THE INVENTION

1. Field of the Invention

The present invention relates to a process for manufacturing a fluid jetting apparatus, and more particularly, to a process for manufacturing a fluid jetting apparatus of a print head employed in output apparatuses such as an ink jet printer, a facsimile machine, etc., to jet fluid through a nozzle.

2. Description of the Related Art

A print head is a part or a set of parts which are capable of converting output data into a visible form on a predetermined medium using a type of printer. Generally, such a print head used for an ink jet printer, and the like, uses a fluid jetting apparatus which is capable of jetting a predetermined amount of fluid through a nozzle to an exterior of a fluid chamber holding the fluid by applying a physical force to the fluid chamber.

According to methods for applying a physical force to the fluid within the fluid chamber, a fluid jetting apparatus is roughly grouped into a piezoelectric system and a thermal system. The piezoelectric system pushes out ink within the fluid chamber through a nozzle through an operation of a piezoelectric element which is mechanically expanded in accordance with a driving signal. The thermal system pushes the fluid through the nozzle by means of bubbles which are produced out of the fluid within the fluid chamber by the heat generated by an exothermic body. Recently, also, a thermal compression system has been developed, which is an improved form of the thermal system. The thermal compression system jets the fluid by driving a membrane by instantly heating a vaporizing fluid which acts as working fluid.

FIG. 1 is a vertical sectional view of a fluid jetting apparatus according to a conventional thermal compression system. A fluid jetting apparatus of the thermal compression system includes a heat driving part 10, a membrane 20, and a nozzle part 30.

A substrate 11 of the heat driving part 10 supports the heat driving part 10 and the whole structure that will be constructed later. An insulated layer 12 is defused on the substrate 11. An electrode 14 is a conductive material for supplying an electric power to the heat driving part 10. An exothermic body 13 is a resistive material having a predetermined resistance for expanding a working fluid by converting electrical energy into thermal energy. Working fluid chambers 16 and 17 contain the working fluid, to maintain the pressure of the working fluid which is expanded by heat, are connected by a working fluid introducing passage 18, and are formed with a working fluid barrier layer 15.

Further, the membrane 20 is a thin diaphragm which is adhered to an upper portion of the working fluid barrier layer 15 and the working fluid chambers 16 and 17 are moved upward and downward by the pressure of the expanded working fluid. The membrane 20 includes a polyimide coated layer 21 and a polyimide adhered layer 22.

Jetting fluid chambers 37 and 38 are chambers, formed to enclose the jetting fluid, which are designed to jet the fluid only through a nozzle 35 formed in the nozzle plate 34 when the pressure transmitted through the membrane 20 is applied to the jetting fluid. The jetting fluid is the fluid which is pushed out of the jetting fluid chambers 37 and 38 in response to the driving of the membrane 20, and finally jetted to the exterior. A jetting fluid introducing passage 39 connects the jetting fluid chambers 37 and 38. The jetting fluid chambers 37 and 38 and the jetting fluid introducing passage 39 are formed in a jetting fluid barrier layer 36. The nozzle 35 is an orifice through which the jetting fluid which is held using the membrane 20 and the jetting fluid chambers 37 and 38 is emitted to the exterior. Another substrate 31 of the nozzle part 30 is temporarily employed for constructing the nozzle part 30, and the substrate 31 of the nozzle part 30 should be removed before the nozzle part 30 is assembled.

A process for manufacturing the fluid jetting apparatus according to the conventional thermal compression system will be described below.

FIG. 2 shows a process for manufacturing a fluid jetting apparatus according to a conventional roll method.

As shown in FIG. 2, a nozzle plate 34 is transferred from a feeding reel 51 to a take-up reel 52. In the process of transferring the nozzle plate 34 from the feeding reel 51 to the take-up reel 52, a nozzle is formed on the nozzle plate 34 by laser processing equipment 53. After the nozzle is formed, air is jetted from an air blower 54 so as to eliminate extraneous substances attached to the nozzle plate 34. Next, an actuator chip 40 is bonded with the nozzle plate 34 by a tab bonder 55, and accordingly, the fluid jetting apparatus is completed. The completed fluid jetting apparatuses are wound around the take-up reel 52 to be preserved, and then sectioned in pieces in the manufacturing process for the print head. Accordingly, each piece of the fluid jetting apparatuses is supplied into the manufacturing line of a printer.

FIGS. 3A and 3B are views for showing a process for manufacturing the heat driving part and FIG. 3C is a view for showing a process for manufacturing the membrane on the heat driving part of the conventional fluid jetting apparatus. FIGS. 4A to 4C are views for showing a process for manufacturing the nozzle part.

In order to manufacture the conventional fluid jetting apparatus, the heat driving part 10 and the nozzle part 30 should be manufactured separately. Here, the heat driving part 10 is completed as the separately-made membrane 20 is adhered to the working fluid barrier layer 15 of the heat driving part 10. After that, by reversing and adhering the separately-made nozzle part 30 to the membrane 20, the fluid jetting apparatus is completed.

FIG. 3A shows a process for diffusing the insulated layer 12 on the substrate 11 of the heat driving part 10, and for forming the exothermic body 13 and the electrode 14 on the insulated layer 12 in turn. Referring to FIG. 3B, the working fluid chambers 16 and 17 and the working fluid introducing passage 18 are formed by an etching process of the working fluid barrier layer 15 through a predetermined mask patterning. More specifically, the heat driving part 10 is formed as the insulated layer 12, the exothermic body 13, the electrode 14, and the working fluid barrier layer 15 are sequentially laminated on the substrate 11 (which is a silicon-substrate). The working fluid chambers 16 and 17 which are filled with the working fluid to be expanded by heat, are formed on the etched portion of the working fluid barrier layer 15. The working fluid is introduced through the working fluid introducing passage 18.

FIG. 3C shows the separately-made membrane 20 being adhered to the upper portion of the completed heat driving part 10. The membrane 20 is a thin diaphragm, which is to be driven in a direction of the jetting fluid chamber 37 (see FIG. 1) by the working fluid which is heated by the exothermic body 13.

FIG. 4A shows a process for forming the nozzle 35 by the laser processing equipment 53 after an insulated layer 32 and the nozzle plate 34 are sequentially formed on a substrate 31 of the nozzle part 30. FIG. 4B shows a process for forming a jetting fluid barrier layer 36 on the upper portion of the construction shown in FIG. 4A, and then for forming the jetting fluid chambers 37 and 38 and the fluid introducing passage 39 (see FIG. 1) by an etching process through a predetermined mask patterning. FIG. 4C shows a process for exclusively removing the nozzle plate 34 from the conductive layer 32 and the substrate 31 of the nozzle part 30. The nozzle part 30 includes the jetting fluid barrier layer 36 and the nozzle plate 34. On the etched portion of the jetting fluid barrier layer 36, the jetting fluid chambers 37 and 38 which are filled with the fluid to be jetted and the fluid introducing passage 39, are formed. The jetting fluid such as an ink, or the like, is introduced through the jetting fluid introducing passage 39 (see FIG. 1). The nozzle 35 is formed on the nozzle plate 34 to be interconnected with the jetting fluid chamber 37, so that the fluid is jetted out through the nozzle 35. The nozzle part 30 is manufactured by the processes that are shown in FIGS. 4A to 4C. First, the nozzle plate 34 inclusive of the nozzle 35, is formed on the substrate 31 having the insulated layer 32 through an electroplating. Next, the jetting fluid barrier layer 36 is laminated thereon, and the jetting fluid chambers 37 and 38 and the jetting fluid introducing passage 39 are formed through a lithographic process. Finally, as the insulated layer 32 and the substrate 31 are removed, the nozzle part 30 is completed. The completed nozzle part 30 is reversed, and then adhered to the membrane 20 which has been pre-assembled with the heat driving part 10. More specifically, the jetting fluid barrier layer 36 of the nozzle part 30 is adhered to the polyimide coated layer 21 of the membrane 20.

The operation of the fluid jetting apparatus according to the thermal compression system will be described below with reference to the construction shown in FIG. 1.

First, an electric power is supplied through the electrode 14, and an electric current flows through the exothermic body 13 which is connected to the electrode 14. In such a situation, the exothermic body 13 generates a heat due to its resistance. The fluid within the working fluid chamber 16 is subjected to a resistance heating, so that the fluid starts to vaporize when the temperature thereof exceeds a predetermined temperature. As the fluid vaporizes more and more due to the heat, the vapor pressure accordingly increases. As a result, the membrane 20 is driven upward. More specifically, as the working fluid undergoes thermal expansion, the membrane 20 is pushed upward toward the direction indicated by the arrow in FIG. 1. As the membrane 20 is pushed upward, the fluid within the jetting fluid chamber 37 is jetted to the exterior through the nozzle 35.

Then, when the supply of electric power is stopped, the heat from the exothermic body 13 is no longer generated. Accordingly, the fluid within the working fluid chamber 16 is cooled to a liquid state, so that the volume thereof decreases and the membrane 20 recovers its original shape.

Meanwhile, a conventional material of the nozzle plate 34 is mainly made of nickel, but the trend in using a polyimide synthetic resin has increased recently. When the nozzle plate 34 is made of the polyimide synthetic resin, it is fed by a reel type. The fluid jetting apparatus is completed by the way in which a chip is bonded on the nozzle plate 34 fed in the reel type.

With the conventional fluid jetting apparatus, however, since the nozzle plate and the jetting fluid barrier layer should be separately formed during the manufacturing process of the nozzle part, numerous complex processes are required. As a result, the productivity thereof is decreased. Further, if the conventional electroplating method is employed, pressures are not uniformly exerted over the whole area of the substrate due to the uneven thickness, and also due to the technical problems in forming the jetting fluid chambers. Also, according to the conventional system, since the heat driving part-membrane assemblies, and the nozzle parts have to be sectioned in pieces into the respective units to be attached to each other, productivity decreases and the reliability deteriorates.

SUMMARY OF THE INVENTION

The present invention has been made to overcome the above-described problems of the related art, and accordingly, it is an object of the present invention to provide a process for manufacturing a fluid jetting apparatus in which, during the manufacturing process of a nozzle part, a nozzle is integrally formed with jetting fluid chambers on one substrate to be adhered to a heat driving part-membrane assembly on another substrate, and then the final assembly thereof is sectioned in pieces into complete fluid jetting apparatuses.

Additional objects and advantages of the invention will be set forth in part in the description which follows and, in part, will be obvious from the description, or may be learned by practice of the invention.

In order to accomplish the above and other objects of the present invention, a method of manufacturing a fluid jetting apparatus according the present invention includes (A) forming a heat driving part, a membrane, and a nozzle part; and (B) forming a nozzle and jetting fluid chambers sequentially by using one nozzle plate, and assembling the heat driving part, the membrane, and the nozzle part, sequentially.

The step (B) includes (1) laminating the nozzle plate on a substrate; (2) forming the nozzle on the nozzle plate; (3) forming the jetting fluid chambers by extending the nozzle in a depth direction, and (4) separating the nozzle plate from the substrate.

It is preferable that the nozzle plate is adhered to the substrate, and the nozzle plate is abraded to have a predetermined thickness before the step (2).

It is also preferable that the nozzle plate is abraded to have a predetermined thickness by a chemo-mechanical polishing, and the nozzle plate is made of silicon.

It is further preferable that the steps (2) and (3) are carried out through a lithography, respectively, and the step (3) is carried out through an anisotropic etching of the lithography.

Here, it is preferable that the step (4) is executed after the step of sequentially assembling the heat driving part, the membrane, and the nozzle part.

In order to accomplish the above and other objects of the present invention, a process for manufacturing a fluid jetting apparatus includes (A) forming a heat driving part, a membrane, and a nozzle part; and (B) assembling the heat driving part, the membrane, the nozzle part, sequentially, the step (B) including: (1) laminating a nozzle plate of silicon on a substrate; (2) abrading the nozzle plate to have a predetermined thickness by a chemo-mechanical polishing; (3) forming a nozzle in the nozzle plate through a lithography; (4) forming a jetting fluid chamber on an area where the nozzle is formed by an anisotropic etching of the lithography; and (5) separating the substrate from the nozzle plate.

As a result, since the nozzle and the jetting fluid chambers are integrally formed on one substrate of a silicon diaphragm, fewer processes are required. Further, since a flatness of the substrate is excellent, the heat driving part-membrane assembly on one substrate may be assembled with the nozzle part on another substrate.

BRIEF DESCRIPTION OF THE DRAWINGS

The above objects and advantages will become more apparent and more readily appreciated by describing the preferred embodiment in greater detail with reference to the accompanying drawings, in which.

DETAILED DESCRIPTION OF THE PREFERRED EMBODIMENT

Figure 1:
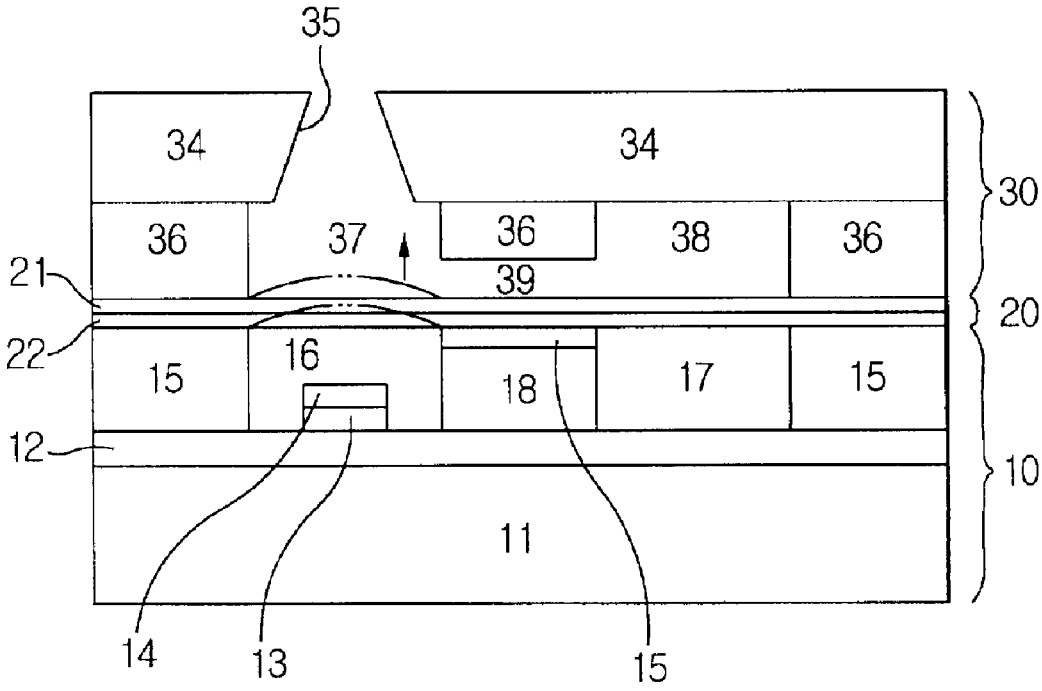
FIG. 1 (PRIOR ART)
FIG. 1 is a vertical sectional view showing a construction of a fluid jetting apparatus according to a conventional thermal compression system.
Figure 2:
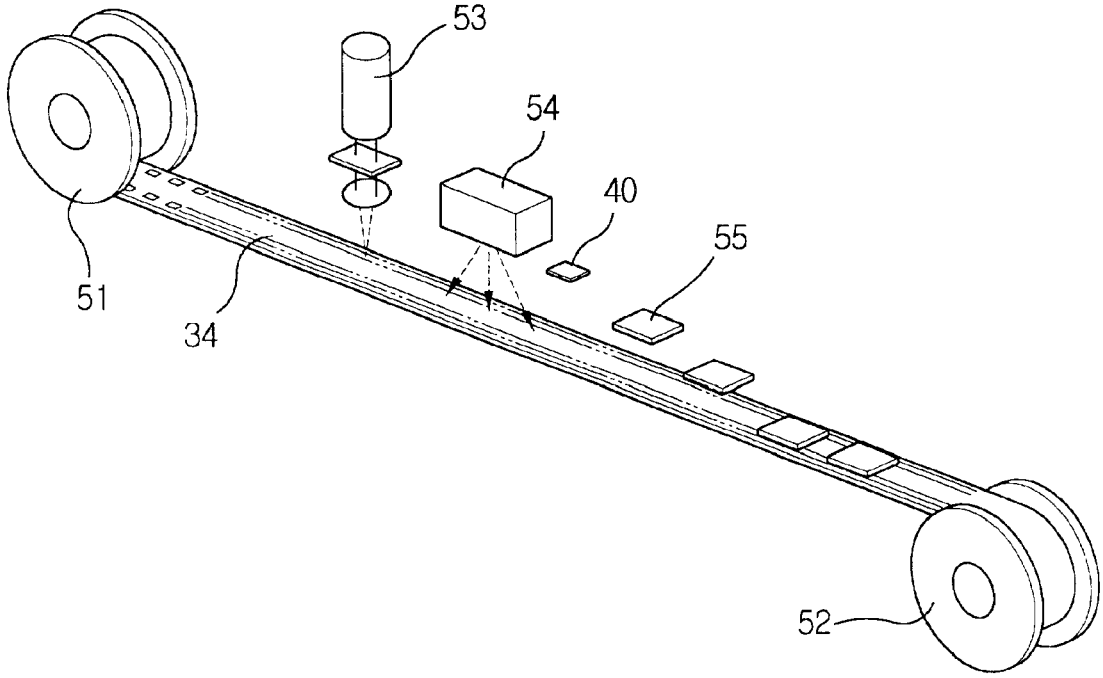
FIG.2 (PRIOR ART)
FIG. 2 is a view showing a process for manufacturing a fluid jetting apparatus according to a conventional roll method.
Figure 3A:
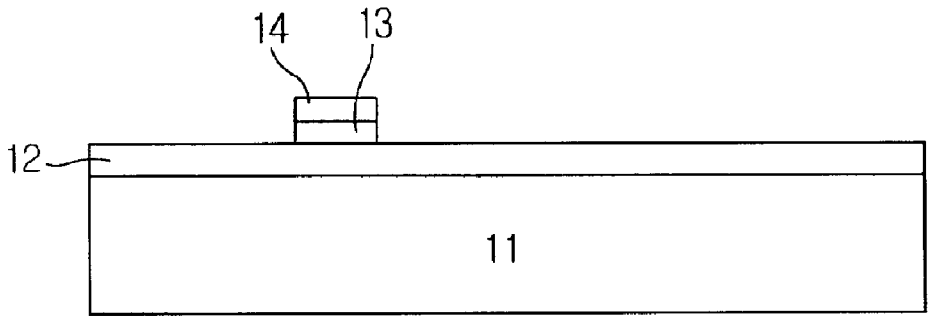
FIG.3A (PRIOR ART)
FIGS. 3A and 3B are views showing a process for manufacturing a heat driving part and FIG. 3C is a view drawing a process for manufacturing a membrane on the heat driving part of the conventional fluid jetting apparatus.
Figure 3B:
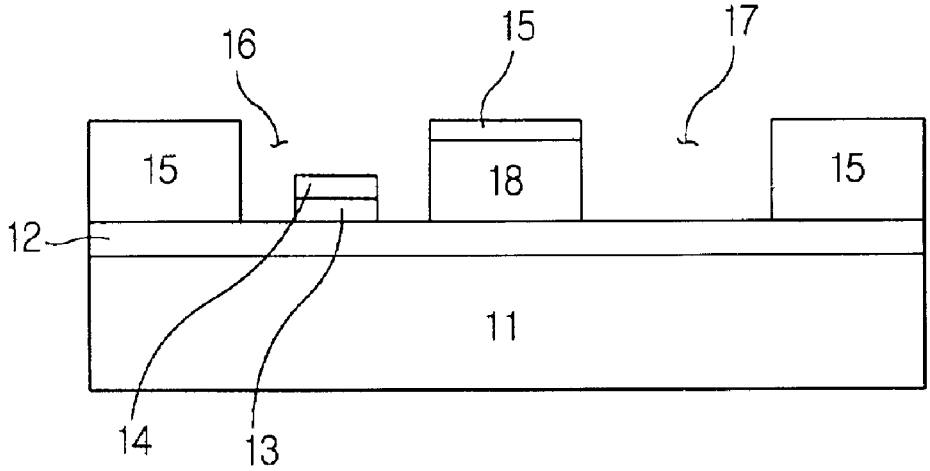
FIG.3B (PRIOR ART)
Figure 3C:
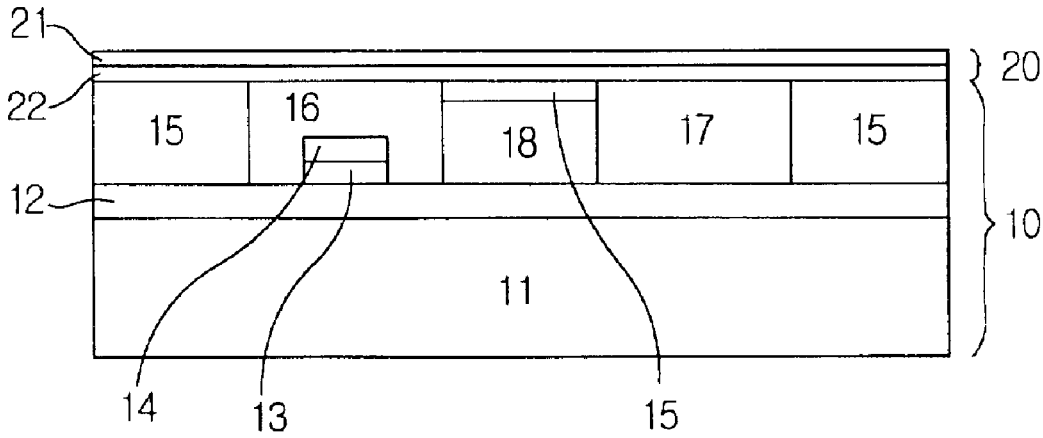
FIG.3C (PRIOR ART)
Figure 4A:
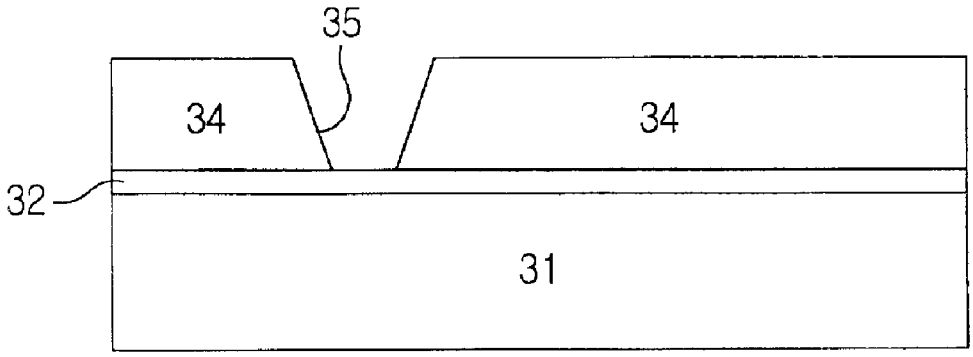
FIG.4A (PRIOR ART)
FIGS. 4A to 4C are views showing a process for manufacturing a nozzle part of the fluid jetting apparatus according to the conventional thermal compression system.
Figure 4B:
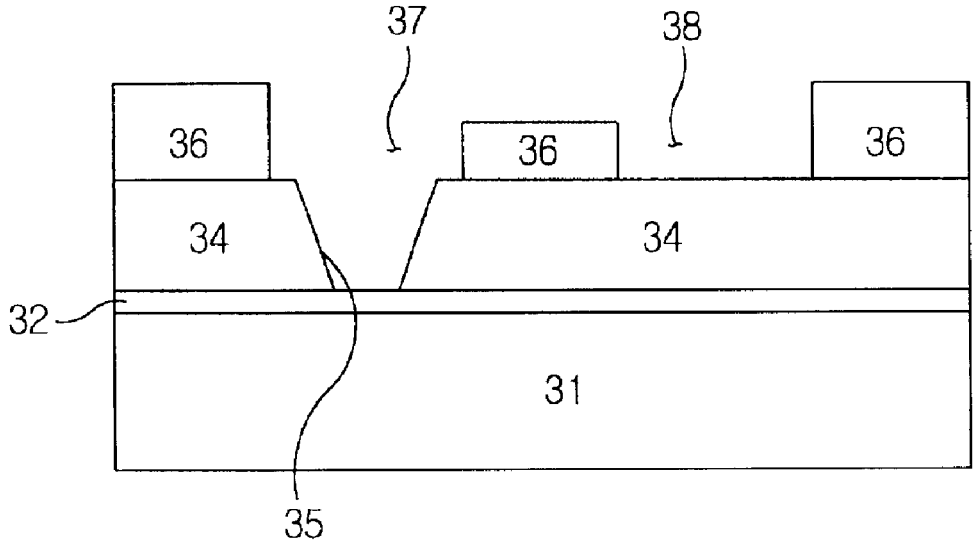
FIG.4B (PRIOR ART)
Figure 4C:
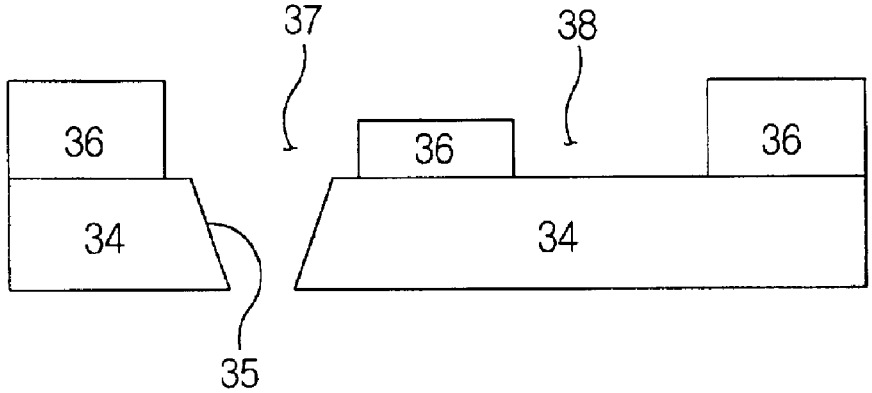
FIG.4C (PRIOR ART)

Reference will now made in detail to the present preferred embodiment of the present invention, examples of which are illustrated in the accompanying drawings, wherein like reference numerals refer to the like elements throughout. The embodiment is described below in order to explain the present invention by referring to the figures.

Figure 5:
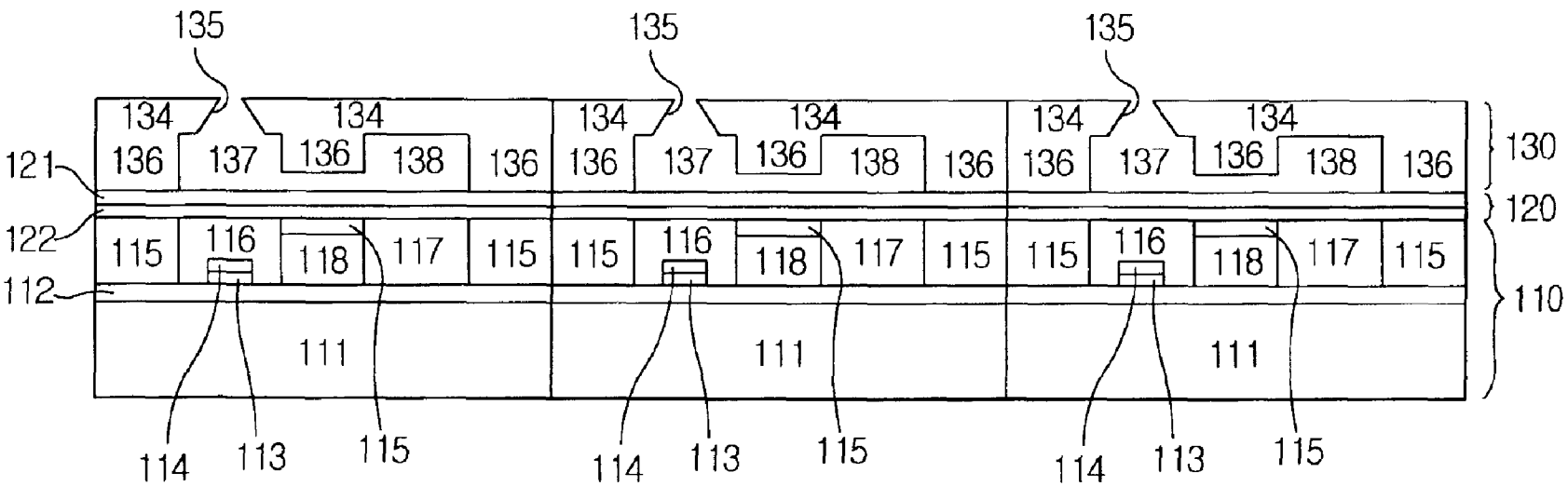
FIG. 5 is a vertical sectional view of a fluid jetting apparatus according to an embodiment of the present invention.

FIG. 5 is a vertical sectional view of a fluid jetting apparatus according to an embodiment of the present invention. Here, a reference numeral 110 is a heat driving part, 120 is a membrane, and 130 is a nozzle part.

The process for manufacturing the fluid jetting apparatus according to an embodiment of the present invention includes the processes of forming the heat driving part 110, forming the membrane 120, forming the nozzle part 130, and sequentially assembling the heat driving part 110, the membrane 120, and the nozzle part 130.

With respect to the heat driving part 110, reference numerals 116 and 117 refer to working fluid chambers, respectively, 114 is an electrode, and 113 is an exothermic body.

Further, the reference numeral 112 is an insulated layer, 111 is a substrate, 115 is a working fluid barrier layer, and 118 is a working fluid passage.

With respect to the membrane 120, the reference numeral 121 is a polyimide coated layer, and 122 is a polyimide adhered layer.

With respect to the nozzle part 130, the reference numeral 134 is a nozzle plate, 135 is a nozzle, 136 is a jetting fluid barrier layer, and 137 and 138 are jetting fluid chambers.

As shown in FIG. 5, a wafer substrate 111 is used for a plurality of the heat driving parts 110, a plurality of the membranes 120 are adhered to the heat driving parts 110, the separately-made nozzle parts 130 are integrally adhered to the membranes 120, and finally, the final assembly thereof is sectioned in pieces into complete fluid jetting apparatuses.

Figure 6A:
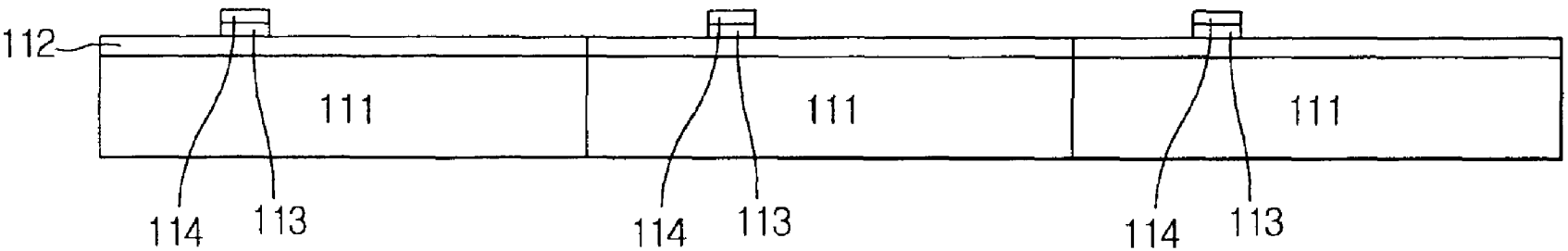
FIGS. 6A and 6B are views showing a process for manufacturing a heat driving part and FIG. 6C is a view showing a processing for manufacturing a membrane on the beat driving part of the fluid jetting apparatus according to the embodiment of the present invention.
Figure 6B:
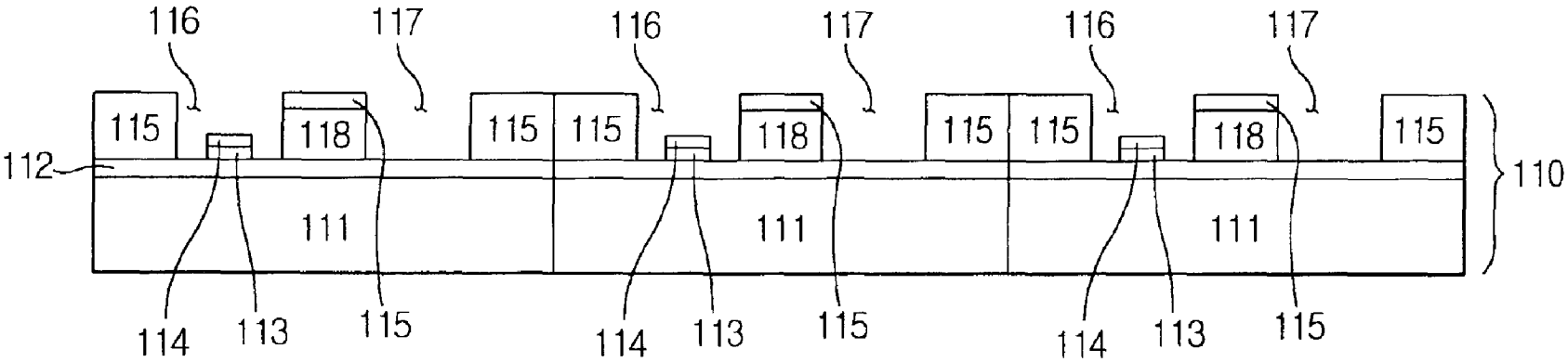
Figure 6C:
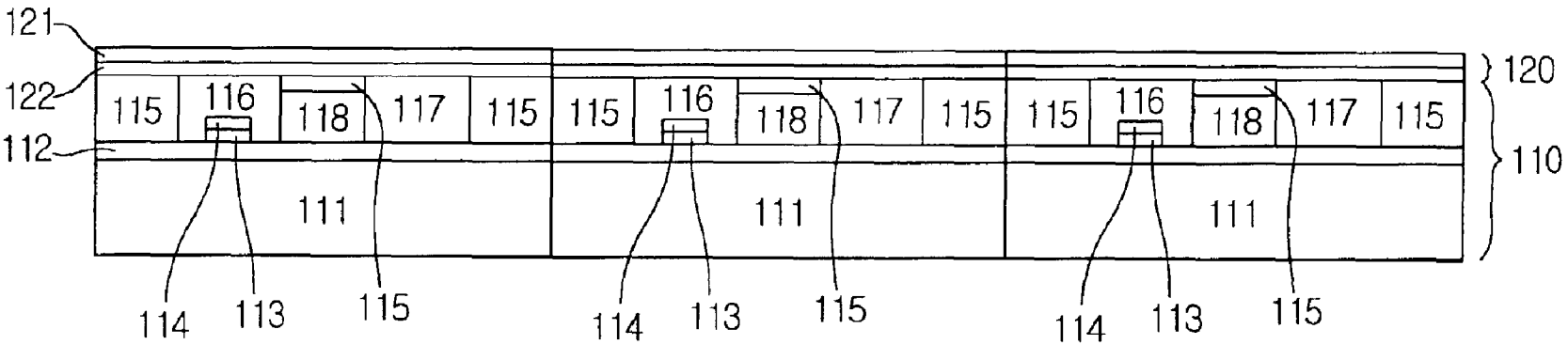

FIGS. 6A and 6B are views for showing a process for manufacturing the heat driving part 110 and FIG. 6C is a view for showing a process for manufacturing a membrane 120 of the fluid jetting apparatus according to the present invention, and FIGS. 7A to 7D are views for showing the manufacturing process for the nozzle part 130 of the fluid jetting apparatus according to the embodiment of the present invention.

Here, the processes for forming the heat driving part 110 and the membrane 120 may be carried out through the conventional method. Accordingly, the description thereof will be briefly described below with reference to FIGS. 6A to 6C, and then the main aspect of the present invention, i.e., the process of forming the nozzle part 130, will be described in greater detail with reference to FIGS. 7A to 7D.

First, as shown in FIG. 6A, metal layers are formed on the substrate 111 which has an insulated layer 112 formed thereon. Initially, a first metal layer is formed on the insulated layer 112, and then the exothermic body 113 is formed by an etching process. After that, another metal layer is formed on the exothermic body 113, then the electrode 114 is formed by an etching process. Next, as shown in FIG. 6B, a working fluid barrier layer or a working fluid diaphragm 115 is formed on the upper portion of the construction shown in FIG. 6A, and then working fluid chambers 116 and 117 and a working fluid passage 118 are formed through the etching process. As a result, the heat driving part 110 is formed. Additionally, a membrane 120, inclusive of a polyimide coated layer 121 and a polyimide adhered layer 122, which is formed on another substrate (not shown), is adhered to the working fluid barrier layer 115. Here, the membrane 120 may be formed on the another substrate and then adhered to the working fluid barrier layer 115, or the membrane 120 may be directly formed on the working fluid barrier layer 115 via a sacrificial layer, or the like.

Figure 7A:
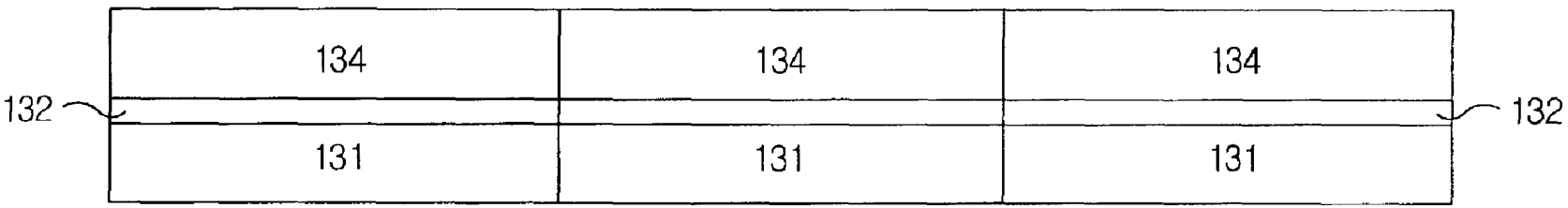
FIGS. 7A to 7D are views showing a process for manufacturing a nozzle part of the fluid jetting apparatus according to the embodiment of the present invention.

Meanwhile, the nozzle part 130 is formed on still another substrate. More specifically, as shown in FIG. 7A, a nozzle plate 134 of a silicon material is laminated on a substrate 131 with an insulated layer 132 by an adhesive or through an anodic-bonding process. Then, the nozzle plate 134 is abraded to have a predetermined thickness that is suitable for forming a nozzle 135 and jetting fluid chambers 137 and 138 and the jetting fluid barrier 136 and a jetting fluid barrier 136 (which are shown in FIG. 7C), through a chemo-mechanical polishing process. Then, as shown in FIG. 7B, the nozzle 135 is formed on a pre-determined area on the nozzle plate 134, through the lithographic process.

Next, as shown in FIG. 7C, the nozzle plate 134 further undergoes the lithographic process, so that the jetting fluid chambers 137 and 138 are formed. In this situation, it is preferable that the etching process of the lithography is carried out by anisotropic etching which has a vertical orientation with respect to the nozzle plate 134. Accordingly, at the same time the surface of the nozzle plate 134 is etched to a uniform depth in a vertical direction, an area where the nozzle 135 has already been formed is more deeply etched than other areas. As a result, the nozzle 135 is formed at a desired position. FIG. 7C shows the jetting fluid chambers 137 and 138 and the jetting fluid barrier 136 and the jetting fluid passage therebetween extending further in a vertical direction by the etching process.

Meanwhile, with respect to the lithographic process to form the nozzle 135 and the jetting fluid chambers 137 and 138 and the jetting fluid barrier 136, the etching process may be a wet etching, or may be a dry etching, such as a reactive ion etching, or the like.

Figure 7B:
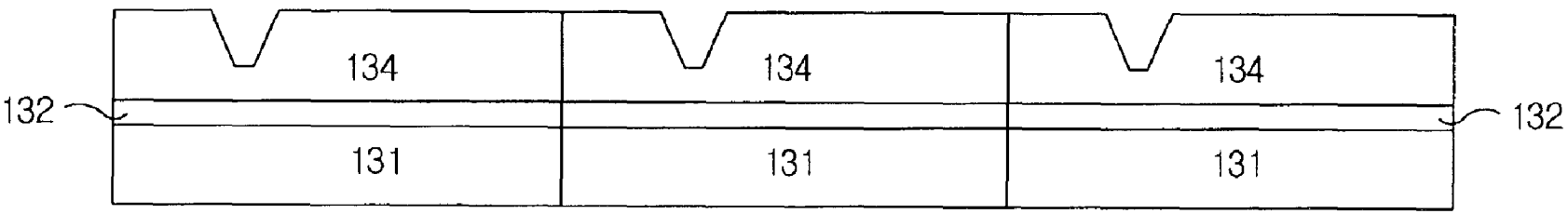
Figure 7C:
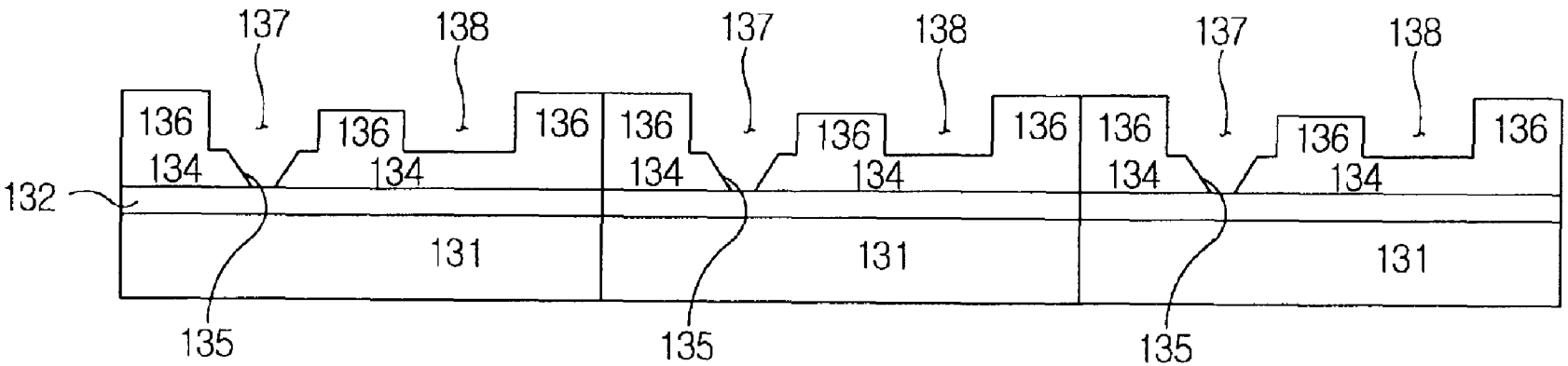

Thus, as shown in FIGS. 7A and 7B, the nozzle is pre-formed by etching the nozzle plate 134 (the result being shown in FIG. 7B). After this, the nozzle plate 134 is re-etched at the pre-etched state (FIG. 7B), then the nozzle 135, the jetting fluid barrier 136, and the jetting fluid chambers 137 and 138 are formed.

Figure 7D:
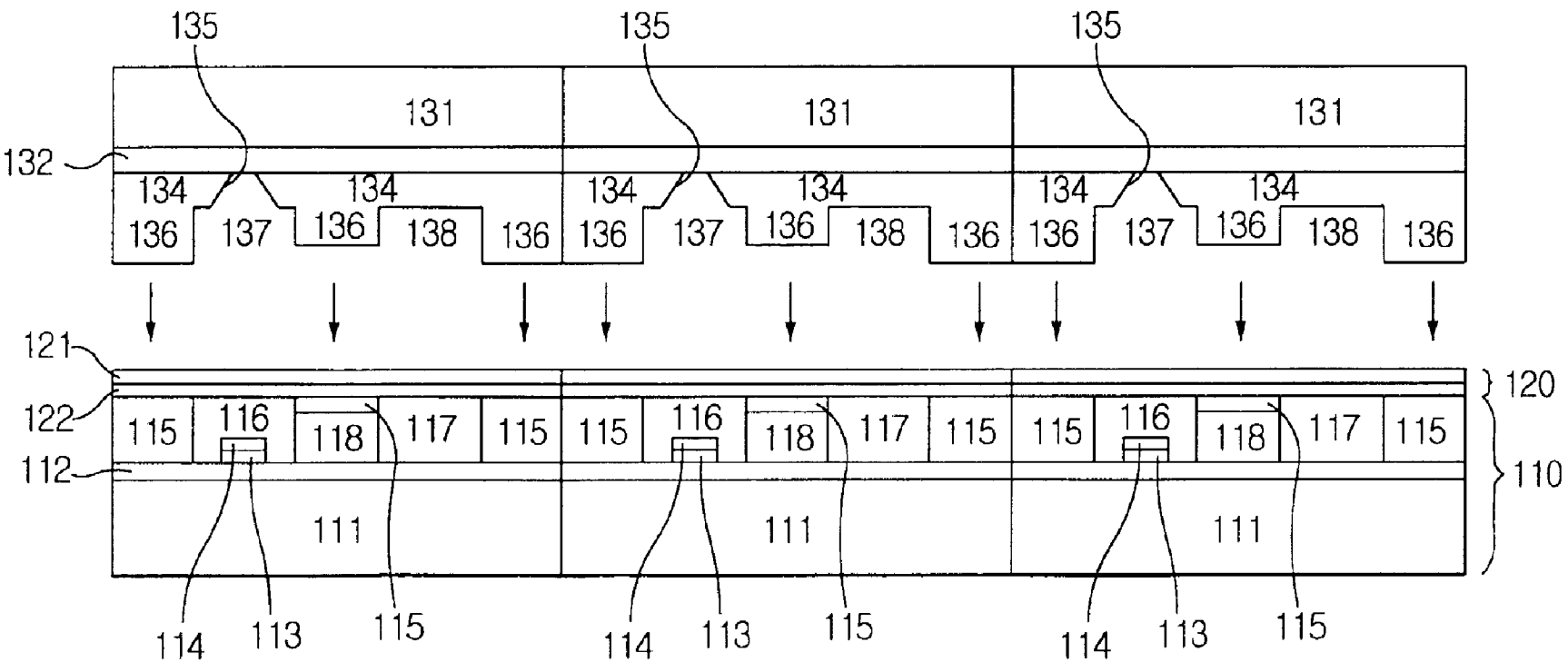

Next, as shown in FIG. 7D, the nozzle part 130 which is now formed with the nozzle 135 and jetting fluid chambers 137 and 138 and the jetting fluid barrier 136, is reversed and assembled with the upper portion of the membrane-heat driving part assembly, i.e., to the membrane 120 of the membrane-heat driving part assembly. An adhesive, or anodic bonding are employed for this assembling process, and here, the respective structures are assembled while being on their respective substrates. Finally, as the substrate 131 and insulated layer 132 are separated from the nozzle part 130, the structure of the fluid jetting apparatuses is completed. Here, the substrate 131 may be separated from the nozzle part 130 before adhering the nozzle part-membrane assembly to the heat driving part 110. Taking into account the property of the assembly work, however, it is more preferable that the substrate 131 is separated from the nozzle part 130 after the completion of the assembly process. After that, the final assembly of the completed fluid jetting apparatuses is sawed into individual fluid jetting apparatuses. The individual fluid jetting apparatuses are then transferred for a process of manufacturing print heads.

As described above, according to the present invention, since the nozzle 135 is formed on a single silicon diaphragm together with the fluid jetting chambers 137 and 138, productivity is increased in comparison with the conventional manufacturing method in which the sectioned nozzle 135 and the fluid jetting chambers 137 and 138 are separately made and assembled with each other. Further, by employing a single diaphragm, the thickness difference on the whole substrate is minimized. As a result, the membrane-heat driving part assembly and nozzle part are enabled to be assembled while being on their own substrates, so that productivity and reliability are greatly increased. According to the present invention, multiple fluid jetting apparatuses are manufactured by bonding a plurality of the heat driving parts 110, on which a plurality of membranes 120 (FIG. 6C), with a plurality of nozzle parts (elements 134 and 136) (FIG. 7C) are formed under the same conditions. Therefore, the thickness of the fluid jetting apparatus formed on one substrate 111 is almost always uniform.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A manufacturing method of a fluid jetting apparatus, comprising:

forming a heat driving part, a membrane, and a nozzle part;

forming a nozzle and jetting fluid chambers sequentially by using one nozzle plate, and assembling the heat driving part, the membrane, and the nozzle part, sequentially; and separating the nozzle plate and the substrate after assembling the heat driving part, the membrane, and the nozzle part sequentially.

2. The manufacturing method as claimed in claim 1, wherein the forming of the nozzle comprises:

laminating the nozzle plate on a substrate;

forming the nozzle in the nozzle plate; and forming the jetting fluid chambers by extending the nozzle in a direction.

3. The manufacturing method as claimed in claim 2, further comprising separating the nozzle plate from the substrate.

4. The manufacturing method as claimed in claim 2, wherein the nozzle plate is adhered to the substrate through the laminating of the nozzle plate on the substrate, the manufacturing method further comprising abrading the nozzle plate to have a predetermined thickness before the forming of the nozzle in the nozzle plate.

5. The manufacturing method as claimed in claim 4, wherein the abrading of the nozzle plate comprises chemo-mechanical polishing the nozzle plate to have the predetermined thickness.

6. The manufacturing method as claimed in claim 2, wherein the nozzle plate is made of silicon.

7. The manufacturing method as claimed in claim 2, wherein the forming of the nozzle and the jetting fluid chamber are performed through a lithography, respectively.

8. The manufacturing method as claimed in claim 2, wherein the forming of the jetting fluid chamber comprises performing an anisotropic etching of the lithography.

9. The manufacturing method as claimed in claim 2, wherein the laminating of the nozzle plate on the substrate comprises:

forming an insulated layer on the substrate; and using an adhesive or an anodic bonding to fix the nozzle plate to the insulated layer.

10. The manufacturing method as claimed in claim 1, wherein the forming of the nozzle and jetting fluid chambers are performed prior to assembling the nozzle part to the membrane.

11. The manufacturing method as claimed in claim 1, wherein the assembling of the nozzle part to the membrane comprises using an adhesive or an anodic bonding to fix the nozzle part to the membrane.

12. A manufacturing method of a fluid jetting apparatus, comprising:

forming a heat driving part, a membrane, and a nozzle part; and assembling the heat driving part, the membrane, the nozzle part, sequentially, the step assembling of the heat driving part, the membrane, and the nozzle part comprising:

laminating a nozzle plate of silicon on a substrate, abrading the nozzle plate to have a predetermined thickness by a chemo-mechanical polishing, forming a nozzle through a lithography, forming a jetting fluid chamber on an area where the nozzle is formed by an anisotropic etching of the lithography, separating the nozzle plate from the substrate, and separating the nozzle plate and the substrate after assembling the heat driving part, the membrane, and the nozzle part sequentially.

13. A manufacturing method of a fluid letting apparatus, comprising:

forming a heat driving part, a membrane, and a nozzle part; and forming a nozzle and jetting fluid chambers sequentially by using one nozzle plate and assembling the heat driving part, the membrane, and the nozzle part, sequentially, wherein the forming of the nozzle and jetting fluid chambers are performed prior to assembling the nozzle part to the membrane, and wherein the forming of the nozzle and the jetting fluid chambers further comprises assembling the nozzle plate to the membrane subsequent to the forming of the jetting fluid chamber and prior to step of separating of the nozzle plate from the substrate.

14. A method of manufacturing a fluid jetting apparatus, comprising:

forming a nozzle and jetting fluid chambers in a single piece nozzle plate;

attaching the nozzle plate with the nozzle and jetting fluid chambers formed therein to a membrane of a membrane-heat driving part assembly; and separating the nozzle plate from the substrate subsequent to the attaching of the nozzle plate to the membrane.

15. The method as claimed in claim 14, wherein the forming of the nozzle and jetting fluid chambers comprises:

forming the nozzle in the nozzle plate; and forming the jetting fluid chambers by extending the nozzle in a depth direction.

16. The method as claimed in claim 15, wherein the forming of the nozzle and jetting fluid chambers comprises attaching the nozzle plate to a substrate prior to forming the nozzle on the nozzle plate.

17. The method as claimed in claim 16, further comprising abrading the nozzle plate to a predetermined thickness subsequent to attaching the nozzle plate to the substrate and prior to forming the nozzle on the nozzle plate.

18. The method as claimed in claim 15, wherein:

the forming of the nozzle is performed by lithography; and the forming of the jetting fluid chambers is performed by an anisotropic etching in a vertical direction of the nozzle plate, to etch a surface of the nozzle plate to a uniform depth and simultaneously fully form the nozzle.

19. A method of manufacturing a fluid jetting apparatus, comprising:

attaching a nozzle plate to a first substrate and forming a nozzle and jetting fluid chambers in the nozzle plate attached to the first substrate; and attaching the nozzle plate attached to the first substrate to a membrane attached to a heat driving part which is attached to a second substrate; and removing the first substrate from the nozzle plate subsequent to the attaching of the nozzle plate to the membrane.

20. The method as claimed in claim 19, wherein the membrane attached to the heat driving part which is attached to the second substrate is formed by a method of:

attaching the heat driving part to the second substrate; and attaching the membrane to the heat driving part attached to the second substrate.

21. The method as claimed in claim 19, wherein the forming of the nozzle and the jetting fluid chambers in the nozzle plate comprises:

forming the nozzle in the nozzle plate; and forming the jetting fluid chambers by extending the nozzle in a depth direction.

22. The method as claimed in claim 21, wherein the nozzle plate is a single piece of silicon.

23. The method as claimed in claim 21, further comprising abrading the nozzle plate prior to forming the nozzle in the nozzle plate.

24. The method as claimed in claim 21, wherein the forming of the nozzle and the forming of the jetting fluid chambers are performed through a lithography.

* * * * *

UNITED STATES PATENT AND TRADEMARK OFFICE

CERTIFICATE OF CORRECTION

PATENT NO. : 6,988,316 B1
APPLICATION NO. : 09/455152
DATED : January 24, 2006
INVENTOR(S) : Soon-cheol Kweon et al.

It is certified that error appears in the above-identified patent and that said Letters Patent is hereby corrected as shown below:

Column 9, line 8, change “letting” to --jetting--.

Signed and Sealed this

Twenty-fourth Day of April, 2007

JON W. DUDAS
*Director of the United States Patent and Trademark Office*